US005988099A

United States Patent [19]

Ferrell

[11] Patent Number: 5,988,099

[45] Date of Patent: Nov. 23, 1999

[54] DEPLOYABLE BOAT ROOF WITH INFLATABLE MEMBER

[76] Inventor: Richard S. Ferrell, 39595 Higbee Rd., Albany, Oreg. 97321

[21] Appl. No.: 09/094,856

[22] Filed: Jun. 15, 1998

[51] Int. Cl.[6] ..... B63B 17/00

[52] U.S. Cl. ..... 114/361; 114/345; 114/348

[58] Field of Search ..... 114/343, 361, 114/348, 345, 349; 441/38, 40

[56] References Cited

U.S. PATENT DOCUMENTS

| | | | |
|---|---|---|---|
| 3,734,047 | 5/1973 | Burton | 114/361 |
| 3,810,266 | 5/1974 | Iller | 114/361 |
| 4,036,520 | 7/1977 | Zuidema | 296/23 B |
| 4,261,613 | 4/1981 | Alford | 296/156 |
| 4,333,191 | 6/1982 | Long | 114/344 |
| 4,554,884 | 11/1985 | Bouliane | 114/344 |
| 5,662,063 | 9/1997 | Seijas | 114/361 |

FOREIGN PATENT DOCUMENTS

| | | | |
|---|---|---|---|
| 226884 | 11/1958 | Australia | 441/38 |
| WO 92/13755 | 8/1992 | WIPO . | |

OTHER PUBLICATIONS

Abstract for publication Australia 8426033 A, puiblished Oct. 4, 1984, Harris, R.K. inventor.

*Primary Examiner*—Sherman Basinger
*Attorney, Agent, or Firm*—James D. Givnan, Jr.

[57] ABSTRACT

A roof structure is adapted for removable attachment to a boat permitting use of the roof as an emergency float for boat occupants. The roof includes a shell having a buoyant member affixed thereto with an inflatable ring carried on the shell in a collapsed manner. A source of pressurized air is in controlled communication with the inflatable ring. Roof support structure includes lug equipped plates on the boat and the roof which, upon roof repositioning, permits separation and launching of the roof. A modified form of root support structure includes deck mounted, swingably mounted upright supports located adjacent the roof sides and which permit lowering of the roof into the water. The inflatable ring contributes to buoyancy as well as occupant protection from the water.

14 Claims, 2 Drawing Sheets

DEPLOYABLE BOAT ROOF WITH INFLATABLE MEMBER

BACKGROUND OF THE INVENTION

The present invention pertains generally to boats, primarily of the recreational type, and to survival equipment carried thereby.

Small boats used for recreational or work purposes are typically limited in their survival equipment to personal floatation gear such as life vests, life rings, survival suits, etc. While such equipment is highly desirable, a drawback exists in that in some emergencies there is inadequate time for boat occupants to don such equipment, as for example, when an underwater obstruction punctures the boat hull flooding same in a very short period of time. Life vests and life rings do not protect the wearer from hypothermia while survival suits are not practical for recreational boating.

SUMMARY OF THE PRESENT INVENTION

The present invention pertains generally to small boats of the recreational or working type where a roof structure serves a secondary purpose of providing a float for survival purposes.

The roof structure includes an inflatable barrier in place about its perimeter and which is inflated from an air tank stowed or carried by the roof structure. Provision is made for ready detachment of the roof structure from the boat and subsequent inverting and launching of the structure either manually or with the aid of a swingable support mounted adjacent one side of the boat hull. A locking arrangement permits the roof to be maintained in a secure manner atop the cabin and upon being unlocked enables rapid separation of the roof structure for launching to one side of the boat. A modified roof structure is supported by frame members, one of which swings to one side of the boat to launch the buoyant roof in an inverted manner.

Important objectives of the present invention include the provision of roof structure for a boat with the structure being of rigid light weight construction normally serving as a roof but adaptable to launching for survival purposes; the provision of a dual purpose roof for a boat with support structure facilitating deployment of the roof structure into the water and inflation of a ring to increase buoyancy and protect users against waves; the provision of a roof structure including a light weight rigid shell and buoyant member thereon defining a cavity for storage of a collapsed ring with a pressurized air source contained on the roof structure for ring inflation; the provision of a roof with support means permitting rapid separation of the roof structure and the inverting of same for deployment into the water; the provision of a roof for a boat with support structure including an upright support pivotally coupled to the boat and roof and facilitating roof deployment in an inverted manner to one side of the boat.

DETAILED DESCRIPTION OF THE PREFERRED EMBODIMENTS

Figures 1, 2, 3, 4, 5:
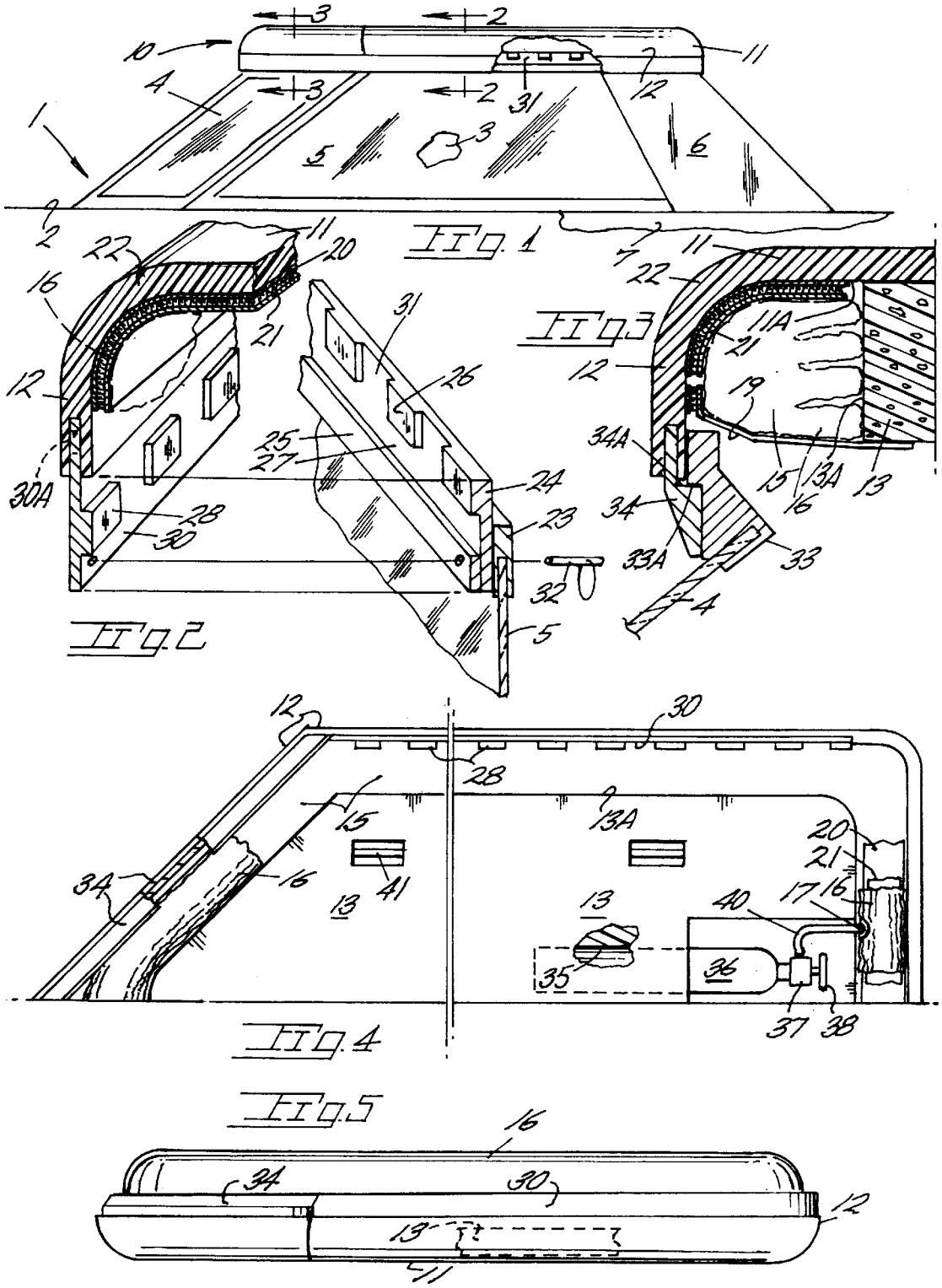
FIG. 1 is a side elevational view of a boat cabin fitted with a deployable roof structure with inflatable ring member.
FIG. 2 is a sectional view taken along line 2—2 of FIG. 1 with the parts separated for purposes of illustration.
FIG. 3 is a vertical sectional view taken along line 3—3 of FIG. 1.
FIG. 4 is a fragmentary bottom plan view of the deployable boat roof removed from support structure and broken away along a centerline.
FIG. 5 is a side elevational view of the roof structure deployed for emergency use.

With continuing attention to the drawings wherein applied reference numerals indicate parts similarly hereinafter identified, the reference numeral 1 indicates generally a boat which may be of the recreational type having a deck 2. A cabin 3 is enclosed by windows including front windows as at 4 and side windows as at 5. A boat hull is at 7.

With attention now to the present invention, a deployable roof with inflatable members is indicated generally at 10 for supported placement by the boat on later described window components and in some instances by cabin structure at 6 which serves to partially enclose the cabin interior.

With attention again to the deployable roof generally at 10, the same may serve as a roof for the boat cabin and, in emergencies, is readily detachable from support structure of the boat. The roof structure includes shell 11 which is of a width and length to serve as a cabin roof and includes sidewall 12 extending about the shell perimeter. For purposes of weight and strength shell 11 may be of fiberglass construction. Disposed in place on an inner shell surface at 11A is a light weight rigid body 13 which may be of closed cell material affixed in place on surface 11A by a suitable adhesive. Sidewalls as at 13A of light weight body 13 partially define, along with shell wall 12, an area 15 extending about light weight body 13 to receive an inflatable ring 16. Ring 16 is continuous and fitted with an inlet 17 as shown in FIG. 4. The inflatable ring 16 is stowed in a deflated or collapsed manner in area 15 about the light weight structure 13 and held in place against the outer wall 12 of shell 11. A fabric closure strip at 20 extends fully about the inner surface of wall 12 and the curved juncture 22 of wall 12 with the major planar top portion of the shell 11. A companion fabric closure strip 21 is permanently affixed to inflatable ring 15 to aid in confining the ring in area 15 in a collapsed state. The fabric closure strips 20 and 21 are preferably continuous and extend about the inner perimeter of shell 11 to securely retain the ring when inflated. Straps as at 19 provided with closure material at their free ends attach to closure strip 20 for ring retention purposes. If necessary for ring retention, the use of an adhesive along lengthwise extending surfaces of the shell and ring is feasible as indicated at 29 in FIG. 9.

With attention now to FIG. 2, wherein roof support means are shown supporting shell 11 on window structure including a window frame 23 extending along the upper edge of a side window 5. Frame member 23 serves to receive a plate structure 24 extending the length of window frame member 23 and is provided with a rail 25 which, along with spaced apart lugs 26, define a channel at 27. Normally disposed in channel 27 are lugs 28 spaced at intervals along a plate 30 having its upper extremity imbedded within sidewall 12 of shell 11. Plate 30 may be apertured at intervals as at 30A to receive fiberglass material during construction of shell 11. Retention of shell 11 is achieved by the lugs 28 in upward abutment with the underside of lugs 26 of window mounted plate 24 with lug separation achieved by forward displacement of roof 10 to locate lugs 28 below open areas 31 intermediate lugs 26 to permit upward passage therepast of the shell mounted lugs 28. A lock pin 32 locks roof 10 in place on window mounted plate 24 until the pin is extracted permitting disengagement of lugs 26 and 28 for subsequent deployment of the roof.

With attention to FIG. 3 again, the forward end of roof 10 is supported by the frame structure about windshield 4 which includes a frame member 33 along the windshield upper edge. The frame member retains the forwardmost portion of shell sidewall 12 by overlying engagement with a plate member 34 which depends from the lower forward edge of shell wall 12. Plate member 34 includes a surface 34A which engages and locks with a surface 33A on window frame component 33. For roof separation, advancement in a forward direction (relative the boat) of shell 11 the surfaces 33A–34A disengage one another permitting upward displacement of shell 11 simultaneously with the upward passage of side located lugs 28 passing upwardly through spaced apart openings 31 located above side windows 5 of the boat.

The light weight structure 13 adhering to the underside of shell 11, as best shown in FIG. 4, defines a cylindrical opening 35 for inserted reception of an air tank 36 having a valve 37 and handle 38. An air line 40 communicates valve 37 with inflatable ring 16.

For deployment of roof structure 10 in an emergency, such as for example, hull 7 taking on water, the roof structure is unlocked by extraction of lock pins as at 32 to permit relative movement between shell 11 and the support structure 23 and 33 associated with the boat window frames. Such forward movement results in alignment of lugs 28 with openings 31 whereupon the application of lifting forces to the front and rear extremities of the shell will disengage the roof structure. The shell is preferably of fiberglass and structure 13 of expanded rigid foam construction. For roof deployment a side edge of the roof 10 may be momentarily rested on deck surface 2 to facilitate tipping or inverting of same prior to contact with the water. Upon deployment, the inflatable ring 16 is inflated by actuation of valve 37 to provide a barrier to waves. If desired, the light weight body 13 of the floatation device may be provided with hand grips as at 41 to aid users in maintaining their position when in rough water.

Figures 6, 7, 8, 9:
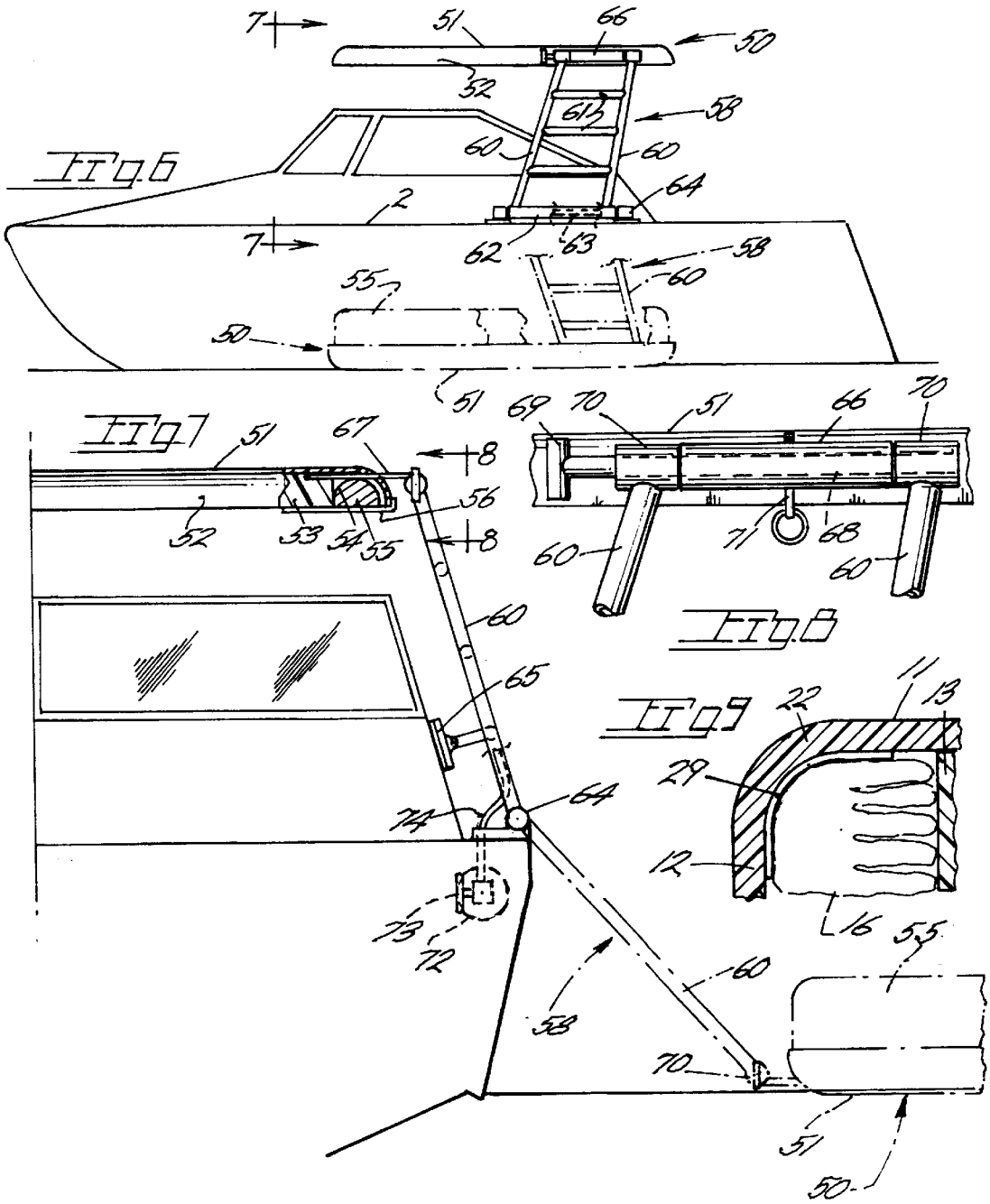
FIG. 6 is a side elevational view of a boat provided with a modified form of the deployable roof structure.
FIG. 7 is an elevational view taken along line 7—7 of FIG. 6.
FIG. 8 is an elevational view taken along line 8—8 of FIG. 7 showing support structure details.
FIG. 9 is a fragmentary view showing a modification for retention of the ring member of the deployable boat roof.

With attention now to FIGS. 6 through 8, a modified form of the roof structure is disclosed generally at 50 and is better suited for use with larger boats. A shell 51 thereof includes a perimeter wall 52 with the internal area of the shell provided with a light weight body 53 such as one of rigid foam material as, for example, Styrofoam. The perimeter of body 53 defines a channel 54 extending about the outer perimeter thereof to receive a collapsed inflatable ring 55. Ring 55 is held in place by the fabric closure arrangement as described in connection with the first described form of the invention. Additionally serving to retain the collapsed ring in place are fabric strips 56, each provided with closure material at their loose ends to attach to cooperating closure material in place on wall 52 of the shell.

Roof support structure, indicated generally at 58, includes a pair of framework supports as at 60 with cross members 61 which, in addition to reinforcing the framework, may subsequently be used as a ladder for boarding the roof when launched. Framework 58 includes a lowermost frame member 62 swingably mounted on a shaft 63 retained in place by deck mounted bosses 64. The description of one support structure 58 is also applicable to the remaining, unseen roof structure on the opposite side of the boat. In place framework 60 is a stop 65 which limits inward movement of support 58 to space same from the side of the boat cabin. The deployable roof generally at 50 is supported as shown in FIG. 6 with a pair of sleeves as at 66 each offset laterally by an arm 67 which extends through sidewall 52 of shell 51. The sleeve 66 of each roof support structure 58 receives a removable pivot shaft 68 carried within a pair of bosses 70 at the upper extremity of the support structure. To prevent accidental loss of shaft 68 a quick release lock pin 71 extends through each sleeve and shaft 68 with a spring biased ball assuring pin retention.

Deployment of roof structure 50 into the water entails the removal of a pivot shaft 68 from one sleeve 66 by its handle at 69. Roof structure 50 may then be swung about shaft 63 of the other upright support structure 58 for launching into the broken line position of FIG. 7. Subsequent to launching quick release pin 71 is removed and subsequently pivot shaft 68 is extracted from the framework bosses 70 permitting sleeve 66 and the floation device to separate from downwardly inclined support structure 58.

Roof structure 50 may be fitted with an onboard source of compressed air such as with the tank 36 shown and described in connection with the first described form of the invention to permit inflation of ring 55 to provide adequate freeboard about the perimeter of shell 51. An alternative source of compressed air may be from a cylinder 72 on the boat and equipped with a control 73 serving an air line 74 entrained for passage along support framework 60 and terminating in communication with inflatable ring 55 to permit inflation of same prior to launching the roof structure and upon removal of fabric closure equipped strips 56. Air line 74 is equipped with a quick disconnect which seals ring 55 upon separation of air line 74. To avoid risk of binding of quick release pin 71 binding in sleeve 66, the pin may be removed prior to outward movement of support 58 during launching. During such an operation rotation of roof structure 50 will jointly occur about the axes of shaft 63 and pivot shaft 68 upon support structure 58 reaching its downwardly inclined position shown in FIG. 7.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. Roof structure for a boat comprising, a shell having a sidewall, a buoyant member affixed to said shell, an inflatable ring stowed in a collapsed condition adjacent said sidewall, means for attaching said ring in place on said shell, a source of pressurized air in valve controlled communication with said ring, and roof support means on said shell for attaching said shell in a removable manner to the boat to permit separation and launching the roof structure in an emergency.

2. The roof structure claimed in claim 1 wherein said buoyant member and said shell jointly define an area to receive the collapsed inflatable ring.

3. The roof structure claimed in claim 1 wherein said means for attaching said ring in place on said shell includes fabric closure members.

4. The roof structure claimed in claim 1 wherein said means for attaching said ring in place on said shell includes an adhesive applied to contacting surfaces of the shell and ring.

5. The roof structure claimed in claim 1 wherein said roof support means includes first and second elongate plates carried respectively by said shell and the boat, said plates each having a series of lugs spaced at intervals therealong, one of said plates defining a channel for lug travel into and out of contact with the lugs of the remaining plate respectively for locking said shell in place and releasing said shell.

6. The roof structure claimed in claim 5 wherein said roof support means includes a lock in inserted engagement with said plates.

7. The roof structure claimed in claim 1 wherein said roof support means includes upright supports each disposed adjacent an opposite side of the boat and pivot means coupling one of said supports to said shell.

8. The roof structure claimed in claim 7 wherein said one of said supports additionally includes pivot means for coupling said one of said supports to the boat.

9. The roof structure as claimed in claim 7 wherein said one of said upright supports include spaced apart crossmembers which may serve as steps to facilitate boarding of the roof structure when afloat.

10. The roof structure as claimed in claim 7 wherein said source of pressurized air is a tank; said buoyant member defining a receptacle for the tank.

11. The roof structure as claimed in claim 7 wherein said source of pressurized air includes an air line extending along one of said supports.

12. A boat roof detachable from the boat for use as a float, said roof including, a shell including a buoyant member, an inflatable ring attached to said shell, a container of pressurized gas in communication with said inflatable ring, and roof support means for attachment of said shell to the boat and including first and second elongate plates, said first plate carried by said shell and slidably engaged with said second plate in place on the boat, locking means engaged with said first and second plates and confining said first plate and said shell against movement relative said second plate.

13. The boat roof claimed in claim 12 wherein said first and second plates each include a series of lugs locking the shell against upward displacement from the boat.

14. A detachable buoyant roof for a boat including, a shell having an inflatable member in place thereon and retention means securing said inflatable member to said shell, shell support structure including upright supports for securement to a boat and having upper and lower ends, pivot means for coupling said upper and lower ends to said shell and said boat and removable lock means confining the upright supports against pivotal movement, and said inflatable member in communication with an air tank and operable upon inflation to form a barrier in place permitting the roof structure to be used as a float upon separation from the boat.

* * * * *